United States Patent [19]

Casull

[11] 4,385,464

[45] May 31, 1983

[54] MOUNTING OF BARRELL AND ACTION TO RIFLE STOCK

[76] Inventor: Richard J. Casull, P.O. Box 276, Freedom, Wyo. 83120

[21] Appl. No.: 187,429

[22] Filed: Sep. 15, 1980

[51] Int. Cl.[3] ..... F41C 23/00

[52] U.S. Cl. ..... 42/75 C

[58] Field of Search ..... 42/71 R, 75 C

[56] References Cited

U.S. PATENT DOCUMENTS 3,206,885 4/1965 Dye ..... 42/75 C

FOREIGN PATENT DOCUMENTS 133578 7/1949 Australia ..... 42/75 C

OTHER PUBLICATIONS

Roy F. Dunlap, "Thoughts on Free-Rifles", The American Rifleman, Apr. 1954, pp. 36-39.

*Primary Examiner*—Stephen C. Bentley

*Attorney, Agent, or Firm*—Terry M. Crellin; B. Deon Criddle

[57] ABSTRACT

The action and barrel of a rifle are mounted to the stock so that the barrel is closely spaced from the front end grip portion of the stock. A rigid insert is fit into an opening through the stock and securely attached to the stock. The action is securely attached to the insert so that the barrel extends along the grip end portion of the stock without making actual contact with the stock. The rifle has greatly improved accuracy inasmuch as the barrel is not subjected to stress and strain due to atmospheric conditions affecting the portion of the stock which cradles the barrel of the rifle.

4 Claims, 3 Drawing Figures

MOUNTING OF BARRELL AND ACTION TO RIFLE STOCK

BACKGROUND OF THE INVENTION

1. Field

This invention relates to means and methods of bedding a rifle barrel and its associated action to the stock of the rifle.

2. State of the Art

Various means have been used to bed the barrel and action of a rifle to the stock. The top of the stock in the area where the barrel and action is to be positioned is recessed so as to conform to the shape of the barrel and action. Clamping means have been used to secure the barrel to the stock, wherein the clamp fits tightly over the barrel with the ends of the clamp secured to the stock. To avoid the external appearance of such a clamp, studs have been secured to the underside of the barrel with the studs being attached to the wood stock. Also, threaded openings have been provided in the underside of the barrel and action with screws extending through the stock to engage the threaded openings and secure the barrel and action to the stock.

3. Objectives

A principal objective of the present invention is to provide a rifle having improved accuracy wherein the barrel of the rifle is not subjected to stress and strain due to atmospheric conditions affecting the forward grip portion of the stock which conventionally cradles a portion of the barrel of the rifle. In particular, one object of the invention is to provide a method of bedding the action of a rifle to the stock so that the barrel portion of the rifle is closely spaced from but does not make actual contact with the front end grip portion of the stock. A further objective is to provide a rifle in which the action associated with the barrel is securely attached to a rigid insert member which, in turn, is secured to an opening in the stock of the rifle. An additional objective is to provide a method of firmly securing the rigid insert member within the opening in the barrel.

SUMMARY OF THE INVENTION

Improved means for mounting a barrel and associated action of a rifle to the stock is disclosed. An opening is provided through the stock in the area where the action is to be positioned. A rigid insert member, preferably cast or machined from metal, is adapted to fit into the opening through the stock. The action to which the barrel is firmly secured is, in turn, attached to the insert member. The insert member is positioned in the opening so that it extends beyond the top edge of the opening by a distance of from about 2 to 10 mils, whereby the barrel is closely spaced from the front end grip portion of the stock without making contact therewith. The insert member preferably has indented slots along opposite sides thereof so that the slots face opposite, lateral, inside surfaces of the opening in the stock. Passage means are provided in the insert member so that glue can be forced therethrough under pressure after the insert member is positioned within the opening. The glue spreads through the indented slots and around the insert member securely attaching the insert member to the stock.

Additional objects and features of the invention will become apparent from the following detailed description taken together with the accompanying drawings.

THE DRAWINGS

An embodiment representing the best mode presently contemplated of carrying out the invention is illustrated in the accompanying drawings in which.

DETAILED DESCRIPTION OF THE ILLUSTRATED EMBODIMENT

Figure 2:
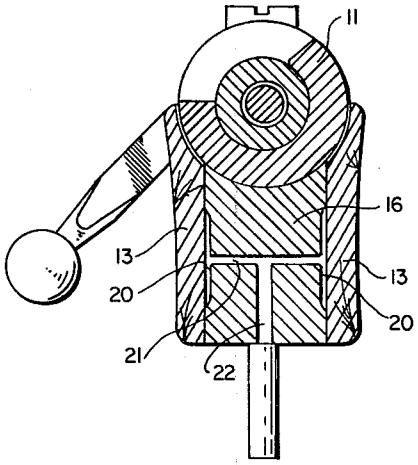
FIG. 2 is a cross-sectional view through the stock and action taken along line 2—2 of FIG. 1.

In a preferred embodiment of the invention as illustrated in the drawings, a firearm in the form of a rifle is provided having an elongate barrel 10 and an action 11 attached to the rear end of the barrel 10. The action 11 and barrel are mounted, to be fully described hereinafter, on a gun stock 12 having a supporting portion 13 for the action 11 and a front end grip portion 14 extending along at least a portion of the length of the barrel 10.

An elongate opening 15 is provided through the supporting portion 13 of the stock 12. The opening 15 communicates through the stock from the lower side thereof to the upper side which cradles the action 11 of the rifle. A rigid insert member 16 is adapted to fit into the opening 15 through the stock 12. The insert member 16 is shaped so as to make a firm, snug fit within the opening 15, and the top surface of the insert member 16 is adapted to extend slightly beyond the corresponding top edge of the opening 15 as shown in FIG. 2. The extension of the top of the insert member 16 above the top edge of the opening 15 is shown exaggerated in FIG. 2 for clarity. In actual practice, the top of the insert member 16 should extend upwardly from the top edge of the opening 15 by a distance of from about 2 to 10 mils.

The upper surface of the insert member 16 is shaped so as to cradle the action 11 of the rifle. An opening 17 is provided in the insert member 16 extending from the top to the bottom thereof. The opening 17 is adapted to receive the trigger mechanism 18 which is attached to and extends downwardly from the action 11. A second opening 19 can be provided in the insert member 16 extending from the top to the bottom thereof with the second opening 19 being adapted to receive a magazine for cartridges which are to be fired sequentially in the rifle.

The insert member 16 is secured to the stock 12 within the opening 15 by gluing the insert member 16 firmly in place within the opening 15. Any commercially available adhesive which can be applied in fluid state under pressure as will be described hereinafter can be used. Preferably a polymeric adhesive such as an epoxy resin, polyester resins, polyurethane resins, vinyl resins, etc. is used.

The insert member 16 is preferably a cast or machined block of metal which fits snugly within the opening 15 in the supporting portion 13 of the stock 12. To accommodate the gluing of such an insert member 16 in the opening 15, a pair of indented slots 20 are provided along opposite sides of the insert member 16 such that the slots 20 face opposite lateral inside surfaces of the opening 15 when the insert member 16 is positioned therein. A cross bore 21 is provided through the insert member 16 from one of the slots 20 to the other. As illustrated, an access bore 22 (FIG. 2) extends upwardly from the bottom surface of the insert member 16 to the cross bore 21; however, the access bore 22 could just as well extend to the cross bore from the top surface of the insert member 16.

In assembling the insert member 16 and stock 12, the rigid mounting block or insert member 16 is positioned within the opening 15 so that the top edge of the insert member 16 extends slightly above the top edge of the opening 15 as explained hereinabove, and an adhesive such as mentioned above is forced through the access bore 22 and cross bore 21 to the slots 20 on each side of the insert member 16. The adhesive sets and bonds the insert member firmly in position.

Figure 1:
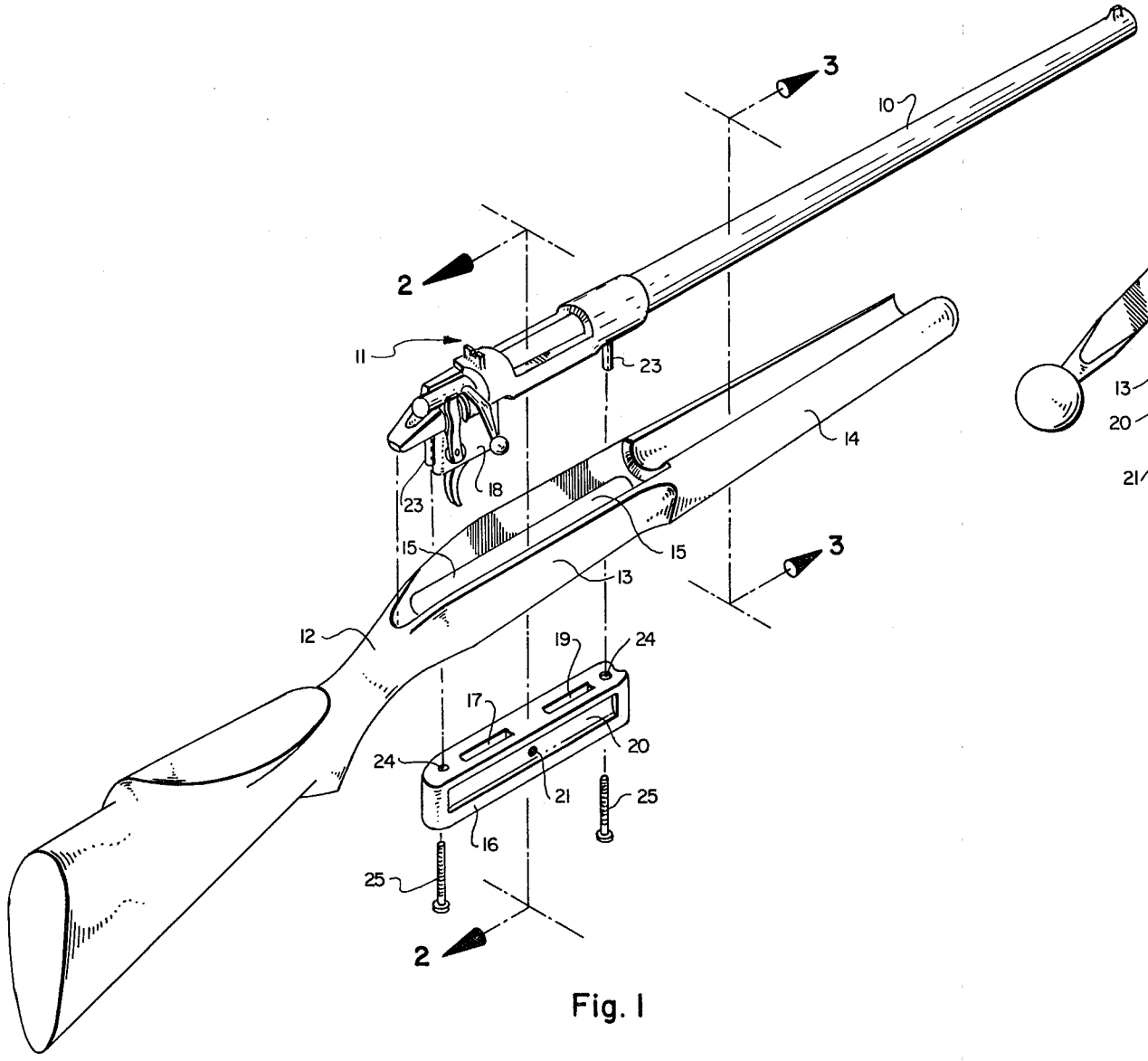
FIG. 1 is an exploded perspective of a rifle in accordance with this invention.

The action is then securely attached to the upper surface of the insert member. As illustrated, mounting posts 23 (FIG. 1) extend downwardly from the lower surface of the action 11 and are received in bores 24 (FIG. 1) which extend through the insert member 16. The posts 23 have internally threaded bores therein, and mounting screws 25 (FIG. 1) are threaded from the bottom of the insert member 16 into the threaded bores in the mounting posts 23 on the action 11.

Figure 3:
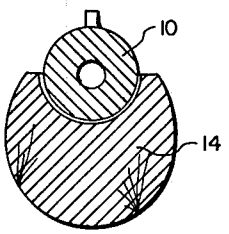
FIG. 3 is a cross-sectional view through the stock and barrel taken along line 3—3 of FIG. 1.

The action 11 and barrel 10 are held firmly to the insert member 16 so that the barrel 10 does not make contact with nor is it supported by the hand grip portion 14 of the stock 12. Because of the firm mounting of the insert member 16 to the stock, the resulting rifle is strong and stable. As shown in FIG. 3, the hand grip portion 14 of the stock is undercut so that it does not make contact with the barrel 10. The space shown in FIG. 3 is exaggerated for clarity. In actual practice the space between the stock and the barrel 10 will be from about 2 to 50 mils. The rifle has extremely good accuracy which is not affected by atmospheric conditions, such as humidity changes, which effect the stock 12. Inasmuch as the barrel is not supported by the stock, dimensional changes which occur in the stock do not effect the barrel 10, and the rifle maintains its accuracy.

Although a preferred form of my invention has been disclosed and illustrated herein, it is to be understood that the present disclosure is made by way of example and that variations are possible without departing from the subject matter coming within the scope of the following claims, which subject matter I regard as my invention.

I claim:

1. In a firearm having an elongate barrel, an action attached to the rear end of the barrel, and an elongate gun stock, said gun stock having a supporting portion for the action and a front end grip portion extending along at least a portion of said barrel, improved means for supporting the action of said barrel comprising:

an opening through the stock at the supporting portion thereof;

a rigid insert member which fits snugly within the opening through said stock and extends beyond the top edge of said opening by a distance of from about 2 to 10 mils;

a pair of indented slots along opposite sides of the insert member such that the slots face opposite lateral inside surfaces of said opening;

means for introducing glue to said slots and thus around the insert member securely gluing the insert member to the stock; and means for securely attaching the action which is attached to the rear end of said barrel to the upper surface of said insert member.

2. A firearm in accordance with claim 1, wherein the rigid insert member is a cast or machined block of metals;

a cross bore is provided through said insert member from one of said slots to the other;

an access bore is provided extending from the top or bottom surface of said insert member to said cross bore; and glue is forced under pressure through the access and cross bores to the slots.

3. A firearm in accordance with claim 2, wherein a magazine receiver opening is provided through the insert member extending from the bottom surface thereof to the top surface for receiving a magazine of cartridges.

4. A method of attaching a barrel and action mounting means to the stock of a rifle comprising:

forming an opening through the stock;

inserting a rigid mounting block within said opening so that the sides of the mounting block fit snugly within said opening, said mounting block having indented slots along at least one pair of opposite sides thereof, so that the slots face mutually respective lateral inside surfaces of said opening, said mounting block further having a cross bore through said block from one of said slots to the other, and an access bore extending from the top or bottom surface of said block to said cross bore; and forcing glue through the access and cross bores to the slots and around the block after the block has been inserted into its snug fit within said opening in said stock.

* * * * *